US009524729B2

(12) United States Patent
Mason et al.

(10) Patent No.: US 9,524,729 B2
(45) Date of Patent: Dec. 20, 2016

(54) SYSTEM AND METHOD FOR NOISE ESTIMATION WITH MUSIC DETECTION

(71) Applicant: QNX Software Systems Limited, Kanata (CA)

(72) Inventors: Steven Mason, Vancouver (CA); Phillip Alan Hetherington, Port Moody (CA); Shreyas Paranjpe, Vancouver (CA)

(73) Assignee: 2236008 Ontario Inc., Waterloo, Ontario (CA)

( * ) Notice: Subject to any disclaimer, the term of this patent is extended or adjusted under 35 U.S.C. 154(b) by 448 days.

(21) Appl. No.: 13/768,100

(22) Filed: Feb. 15, 2013

(65) Prior Publication Data

US 2013/0226572 A1 Aug. 29, 2013

Related U.S. Application Data

(60) Provisional application No. 61/599,767, filed on Feb. 16, 2012.

(51) Int. Cl.

*G10L 21/0208* (2013.01)
*G10L 21/0216* (2013.01)
*G10L 25/81* (2013.01)

(52) U.S. Cl.

CPC ..... *G10L 21/0208* (2013.01); *G10L 21/0216* (2013.01); *G10L 25/81* (2013.01)

(58) Field of Classification Search

CPC ..... G10L 19/028; G10L 19/0208; G10L 21/0272; G10L 25/81; G10L 25/93

USPC ..... 704/226, 246, 278

See application file for complete search history.

(56) References Cited

U.S. PATENT DOCUMENTS

| | | | | |
|---|---|---|---|---|
| 5,778,335 | A * | 7/1998 | Ubale et al. | 704/219 |
| 7,844,453 | B2 * | 11/2010 | Hetherington | 704/228 |
| 2003/0128851 | A1 | 7/2003 | Furuta | |

FOREIGN PATENT DOCUMENTS

| | | | |
|---|---|---|---|
| EP | 0 939 401 | A1 | 9/1999 |
| WO | WO 02/091570 | A1 | 11/2002 |
| WO | WO 02091570 | A1 * | 11/2002 |
| WO | WO 2008/143569 | A1 | 11/2008 |

OTHER PUBLICATIONS

Codec-Independent Sound Activity Detection Based on the Entropy with Adaptive Noise Update. pp. 549-552. 2008. IEEE.*

European Search Report for corresponding European Application EP 13 15 5352.1, dated Jan. 7, 2014, pp. 1-10.

(Continued)

*Primary Examiner* — Thierry L Pham

(74) *Attorney, Agent, or Firm* — Brinks Gilson & Lione

(57) ABSTRACT

In a system and method for noise estimation with music detection described herein provides for generating a music classification for music content in an audio signal. The music detector may classify the audio signal as music or non-music. The non-music signal may be considered to be signal and noise. An adaption rate may be adjusted responsive to the generated music classification. A noise estimate is calculated applying the adjusted adaption rate. The system and method may mitigate the noise modeling algorithms being misled by the music components.

18 Claims, 5 Drawing Sheets

(56) References Cited

OTHER PUBLICATIONS

Jarina, Roman et al., "Rhythm Detection for Speech-Music Discrimination in MPEG Compressed Domain," *IEEE, Digital Signal Processing, 14th International Conference,* vol. 1 (2002) pp. 129-132, U.S.

Martin, Rainer, "Noise Power Spectral Density Estimation Based on Optimal Smoothing and Minimum Statistics," *IEEE Transactions on Speech and Audio Processing,* vol. 9, No. 5 (Jul. 2001) pp. 504-512, U.S.

Thoshkahna, Balaji et al., "A Speech-Music Discriminator Using HILN Model Based Features," *IEEE Acoustics, Speech and Signal Processing,* vol. 5 (2006) pp. V-425-V-428.

Wang, Jun et al., "Codec-independent Sound Activity Detection Based on the Entropy with Adaptive Noise Update," *IEEE Signal Processing, ICSP Guide,* 9th International Conference (2008) pp. 549-552, U.S.

Examination Report for corresponding to European Application No. 13 155 352.1 dated Aug. 7, 2015, 5 pages.

* cited by examiner

SYSTEM AND METHOD FOR NOISE ESTIMATION WITH MUSIC DETECTION

CROSS-REFERENCE TO RELATED APPLICATIONS

This application claims priority from U.S. Provisional Patent Application Ser. No. 61/599,767, filed Feb. 16, 2012, the entirety of which is incorporated herein by reference.

BACKGROUND OF THE INVENTION

1. Technical Field

The present disclosure relates to the field of signal processing. In particular, to a system and method for noise estimation with music detection.

2. Related Art

Audio signal processing systems such as telephony terminals/handsets use signal processing methods (such as noise reduction, echo cancellation, automatic gain control and bandwidth extension/compression) to improve the transmitted speech quality. These components can be viewed as a chain of audio processing modules in an audio processing subsystem.

These signal processing methods rely on a noise modeling method that continually tries to accurately model the environmental noise in an input signal received from, for example, a microphone. The resulting noise model, or noise estimate, is used to control various feature detectors such as speech detectors, signal-to-noise calculators and other mechanisms. These feature detectors directly affect the signal processing methods (noise suppression, echo cancellation, etc.) and thus directly affect the transmitted signal quality.

Noise modeling methods in audio signal processing systems typically assume that the background noise does not contain significant speech-like content or structure. As such when reasonably loud music is present in the environment (that does contain speech-like components) these algorithms act unpredictably causing potentially drastic decreases in transmitted signal quality.

BRIEF DESCRIPTION OF DRAWINGS

The system may be better understood with reference to the following drawings and description. The components in the figures are not necessarily to scale, emphasis instead being placed upon illustrating the principles of the disclosure. Moreover, in the figures, like referenced numerals designate corresponding parts throughout the different views.

Other systems, methods, features and advantages will be, or will become, apparent to one with skill in the art upon examination of the following figures and detailed description. It is intended that all such additional systems, methods, features and advantages be included with this description, be within the scope of the invention, and be protected by the following claims.

DETAILED DESCRIPTION

Figure 1:
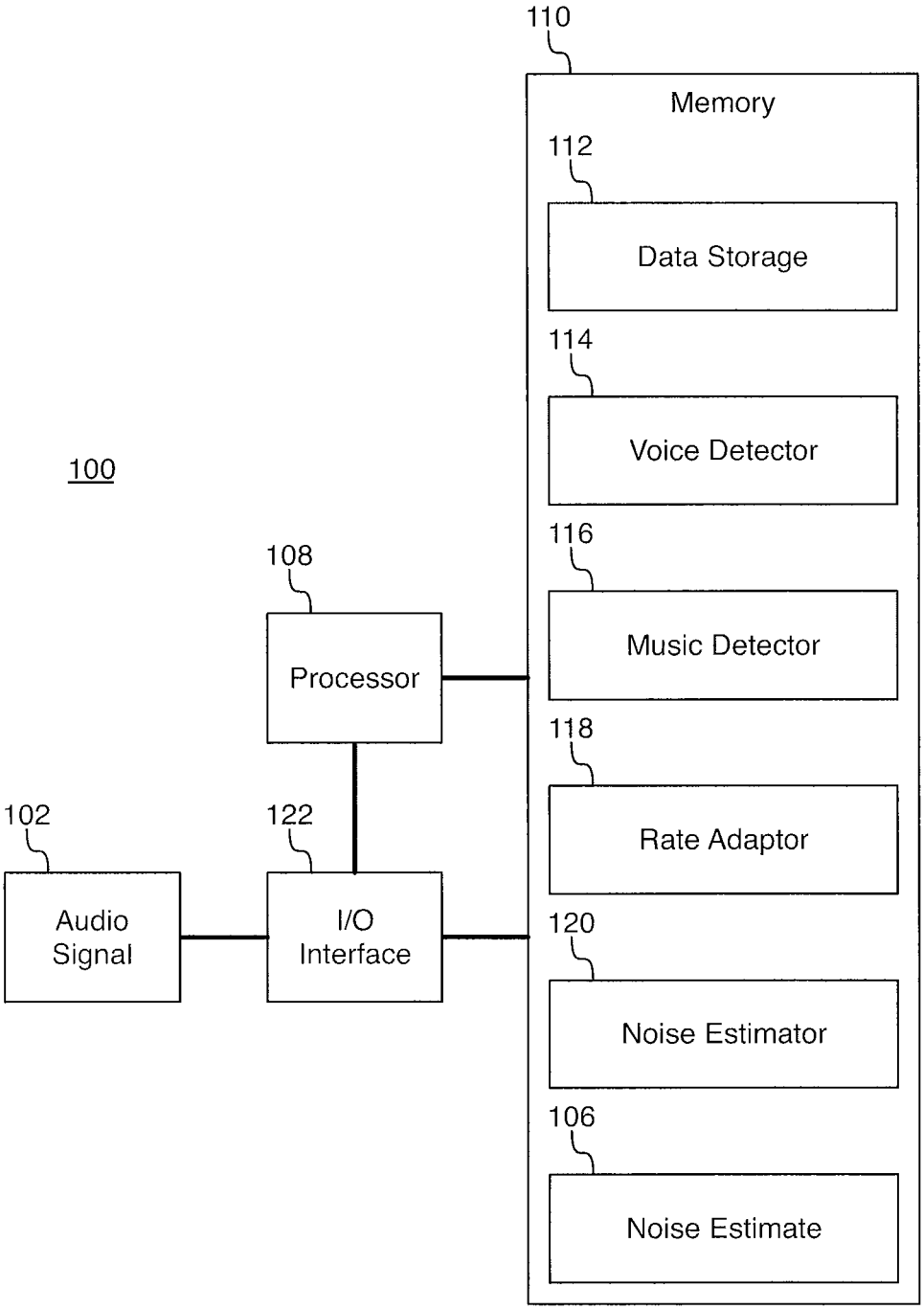
FIG. 1 is a schematic representation of a system for noise estimation with music detection.

In a system and method for noise estimation with music detection described herein provides for generating a music classification for music content in an audio signal. A music detector may classify the audio signal as music or non-music. The non-music signal may be considered to be signal and noise. An adaption rate may be adjusted responsive to the generated music classification. A noise estimate is calculated applying the adjusted adaption rate. The system and method described herein provides for adapting a noise estimate quickly when the noise content changes, while mitigating adaption of the noise estimation in response to the presence of music. Unlike typical noise estimation methods, the system and method for noise estimation with music detection described herein may not attempt to model the music component, instead the system and method may mitigate the noise modeling algorithms being misled by the music components.

The signal quality of many audio signal-processing methods may rely on the accuracy of a noise estimate. For example, a signal-to-noise ratio may be calculated using the magnitude of an input audio signal divided by the noise level. The noise level is typically estimated because the exact noise characteristics are unknown. Errors in the estimated noise level, or noise estimate, may result in further errors in the signal-to-noise calculation that may be utilized in many audio signal-processing methods.

Noise modeling methods in speech systems typically assume that the noise estimate does not contain significant speech-like content or structure. An example noise modeling method that does not include speech-like content in the noise estimate may classify the current audio input signal as speech or noise. When the current audio signal is classified as noise the noise estimate is updated with a processed version of the current audio signal. Typically, noise modeling methods are more complicated, for example, in one implementation, the background noise level estimate is calculated using the background noise estimation techniques disclosed in U.S. Pat. No. 7,844,453, which is incorporated herein by reference, except that in the event of any inconsistent disclosure or definition from the present specification, the disclosure or definition herein shall be deemed to prevail. In other implementations, alternative background noise estimation techniques may be used, such as a noise power estimation technique based on minimum statistics Noise modeling methods in audio signal processing systems may handle environmental noise as well as speech and noise in the audio signal. Music may be considered another environmental noise and as such when reasonably loud music is present in the environment (that does contain speech-like components) the noise modeling methods act unpredictably causing potentially drastic decreases in transmitted signal quality.

Herein are described the system and method for noise estimation with music detection. This document describes an audio signal processing system with a noise estimator and a music detector that can model environmental noise in the presence of music as well as when no music is present to produce a noise estimate. The system and method for noise estimation with music detection may be applied to, for example, telephony use cases where there is speech in a noisy environment or where there is speech and music (aka media) in a noisy environment. The first use case is referred to as (signal+noise) and the second use case as (signal+music+noise). It may be desirable to remove the noise component regardless of whether music is present or not. Typical audio processing systems may not handle removing the noise component in the (signal+noise+music) use case without negatively impacting signal quality. The music may be modeled as having a steady-state music component and a transient music component. Typical noise estimation techniques will attempt to model both (noise+steady-state music). When the noise estimation models transient components then it may also attempt to model the transient music components. This will typically cause feature detectors and audio processing algorithms to fail, by over-attenuating, distorting, temporally clipping speech or by passing bursts of distorted music. The system and method for noise estimation with music detection may provide a conservative noise estimate such that noise is removed during the (signal+noise) case and noise, or a fraction of noise, is removed during the (signal+music+noise) case. In the latter case, modeling only a fraction of the noise as the music component often masks any residual noise that is passed.

FIG. 1 is a schematic representation of a system for noise estimation with music detection 100. The system for noise estimation with music detection receives an audio signal 102, processes the audio signal 102 and outputs a noise estimate 106. The system for noise estimation with music detection may comprise a processor 108, a memory 110 and an input/output (I/O) interface 122. The processor 108 may comprise a single processor or multiple processors that may be disposed on a single chip, on multiple devices or distribute over more than one system. The processor 108 may be hardware that executes computer executable instructions or computer code embodied in the memory 110 or in other memory to perform one or more features of the system. The processor 108 may include a general processor, a central processing unit, a graphics processing unit, an application specific integrated circuit (ASIC), a digital signal processor, a field programmable gate array (FPGA), a digital circuit, an analog circuit, a microcontroller, any other type of processor, or any combination thereof.

The memory 110 may comprise a device for storing and retrieving data or any combination thereof. The memory 110 may include non-volatile and/or volatile memory, such as a random access memory (RAM), a read-only memory (ROM), an erasable programmable read-only memory (EPROM), or a flash memory. The memory 110 may comprise a single device or multiple devices that may be disposed on one or more dedicated memory devices or on a processor or other similar device. Alternatively or in addition, the memory 110 may include an optical, magnetic (hard-drive) or any other form of data storage device.

The memory 110 may store computer code, such as a voice detector 114, a music detector 116, a rate adaptor 118, a noise estimator 120 and/or any other module. The computer code may include instructions executable with the processor 108. The computer code may be written in any computer language, such as C, C++, assembly language, channel program code, and/or any combination of computer languages. The memory 110 may store information in data structures such as the data storage 112 and one or more noise estimates 106. The I/O interface 122 may be used to connect devices such as, for example, microphones, and to other components internal or external to the system.

Figure 2:
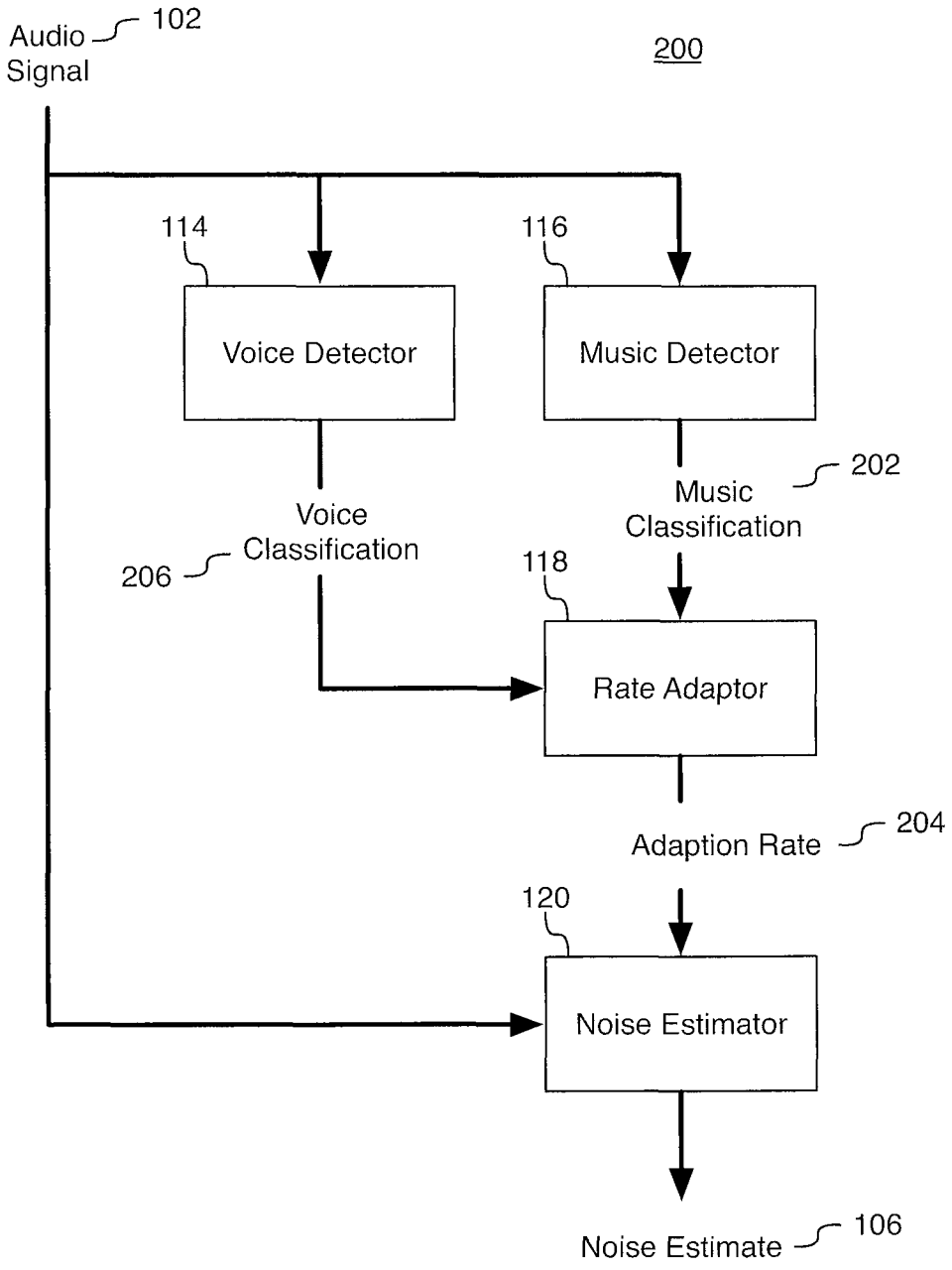
FIG. 2 is a further schematic representation of components of the system for noise estimation with music detection.

FIG. 2 is a further schematic representation of components of the system for noise estimation with music detection 200. A music detector 116 processes the audio signal 102 to generate a music classification 202. The music detector 116 may classify the audio signal 102 as music or non-music. The non-music signal may be considered to be (signal+noise). The music classification 202 is not limited to a binary classification of music versus non-music. In an alternative music detector 116 the music classification 202 may take the form of a value selected from a range of values, the value indicating an amount of music versus non-music. The music detector 116 algorithms may use harmonic content, temporal structure, beat detection or other similar measures to generate the music classification 202. In an alternative music detector 116, the music classification 202 may include more than one type of music component; for example, separate music classification 202 values for steady-state music and transient music components. The music detector 116 may smooth, or filter, the music classification 202 over time and frequency.

An example music detector 116 may use algorithms that estimate the presence and amount of music content. One approach may include the use of an autocorrelation-based periodicity detector that identifies periodic audio components including tones and harmonics that are typical of music content. This approach applies to both narrowband and wideband audio signals so the autocorrelation-based periodicity detector may be preceded by several other components. For example, a "sloppy" downsampler without an anti-alias filter may be used to increase the computational efficiency in the autocorrelation but allowing aliasing to increase partial content. An example "sloppy" downsampler may half the sample rate by discarded every other sample or mixing every other sample. Another example approach may comprise one or more filters to remove common periodic components (e.g. 60 Hz). The autocorrelation-based periodicity detector works well for certain types of music, but for other types, the inclusion of other detectors to recognize musical content (such as beat detectors or other methods) may be used to indicate the presence of music components.

Figure 5:
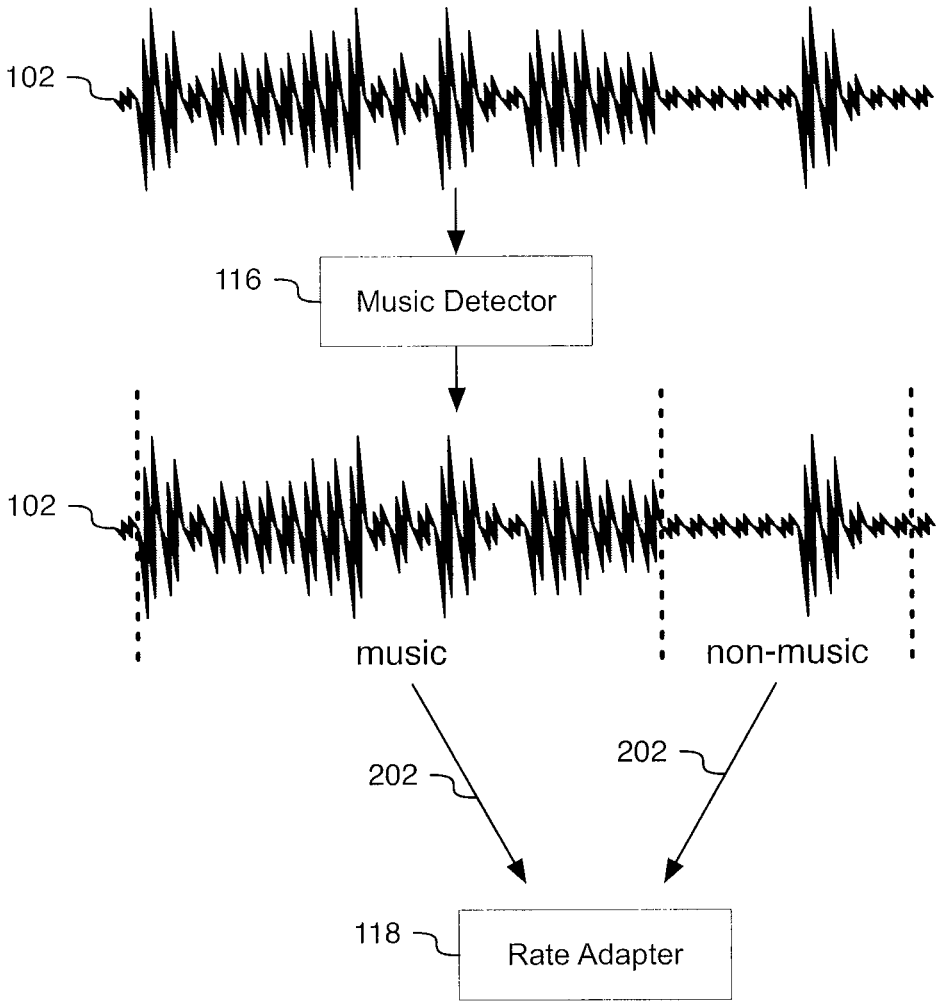
FIG. 5 is a schematic representation of a music detector that provides for adjusting the adaption rate of the noise estimation based on music and non-music classification.

FIG. 5 is a schematic representation of a music detector that provides for adjusting the adaption rate of the noise estimation based on music classification. The output of the music detector 116, i.e. the music classification 202, may be used to govern the rate adaptor 118 that calculates the adaption rate 204 or adaption rates 204. When music is detected, the noise estimate adapt-up-rate may be proportional to (e.g. is a function of) the output of the algorithms in the music detector 116, for example, maximum for no music component and less according to the amount or strength of music detected. Also the noise estimate adapt-down-rate may be increased (e.g. doubled) to provide a conservative estimate of the noise. Effectively the noise estimation may be biased down and requires more sustained evidence during non-music/non-speech times before it rises again.

A noise estimate 106 may be calculated using the adjusted adaption rate. The noise estimate calculation may be continuous, periodic or aperiodic. The adaption rate 204 may be used in the calculation of the new noise estimate 106. The noise estimator 120 may use the adaption rate 204 to generate the noise estimate 106. The adaption rate 204 may govern the noise estimator 120 where no adaption is made to the noise estimate 106 if music is present through to full adaption if no music is present. Other embodiments comprise techniques that may allow the noise estimator 120 to adapt in the presence of music. The music detector 116 may be incorporated in the noise estimator 120 or may alternatively be a cooperating component separate from the noise estimator 120.

Figure 4:
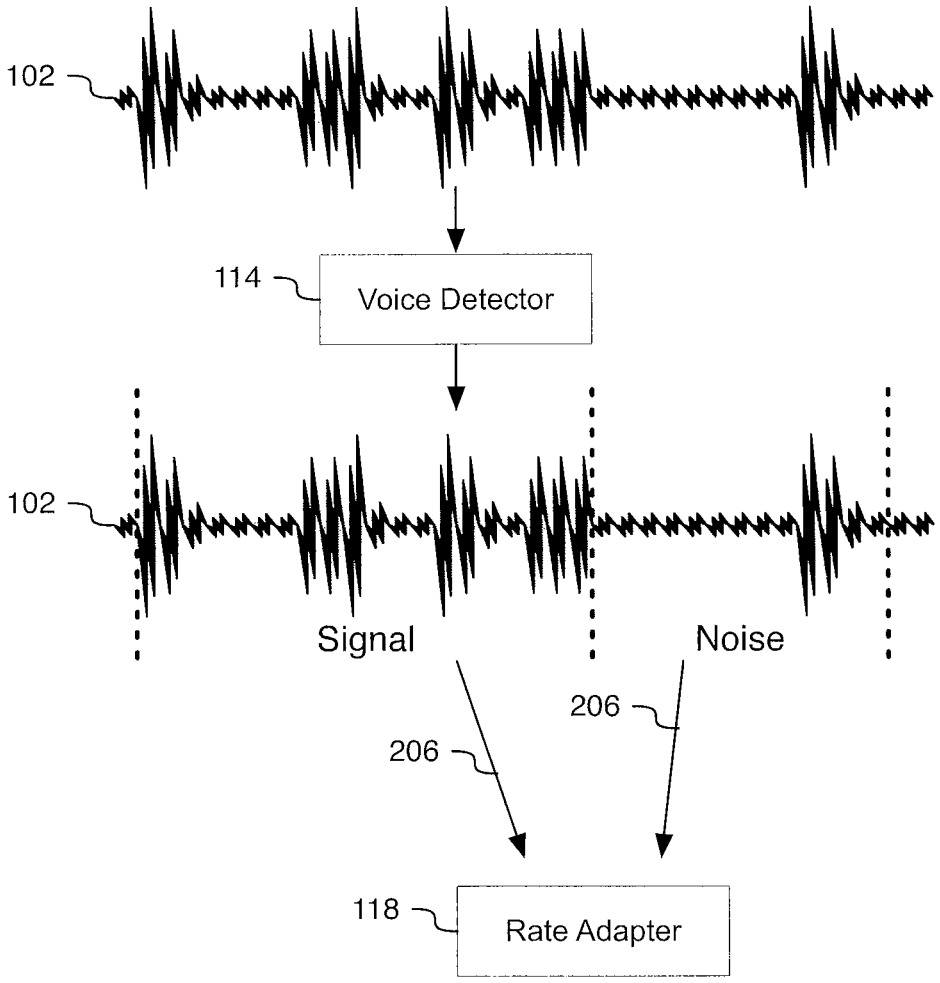
FIG. 4 is a schematic representation of a voice detector that provides for adjusting the adaption rate of the noise estimation based on voice classification.

FIG. 4 is a schematic representation of a voice detector that provides for adjusting the adaption rate of the noise estimation based on voice classification. The output of a voice detector 114, i.e. a voice classification 206, may contribute to setting the adaption rate 204. The voice detector 114 classifies the audio signal 102 over time into voice and noise segments. Segments that the voice detector 114 does not classify as voice may be considered to be noise. In an alternative voice detector 114, instead of classifying segments of the audio signal 102 as either voice or noise, the classification can take the form of assigning a value selected from a range of values. For example, when the classification is expressed as a percent: 100% may indicate the signal at the current time is completely voice, 50% may indicate some voice content and 10% may indicate low voice content. The classification may be used to adjust the adaption rate 204. For example, when the current audio signal 102 is classified as not voice (e.g. noise), the adaption rate 204 may be set to adjust more quickly because when the audio signal 102 is not voice then it is likely noise and therefore more representative of what the noise estimate 106 is attempting to calculate.

The rate adaptor 118 may include the output of the music detector 116 and other detectors that may contribute to setting the adaption rate 204. In one embodiment the rate adaptor 118 may set the adaption rate 204 for the noise estimator 120 based only on the output of the music detector 116. In a second embodiment the rate adaptor 118 may set the adaption rate 204 for the noise estimator 120 based on multiple detectors including the music detector 116 and the voice detector 114.

Figure 3:
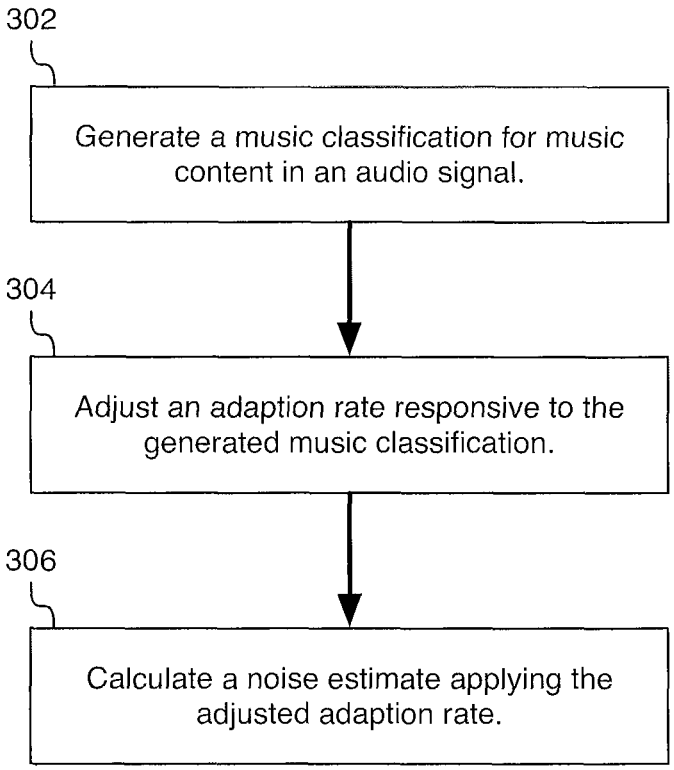
FIG. 3 is a flow diagram representing a method for noise estimation with music detection.

A subband filter may process the received audio signal 102 to extract frequency information. The subband filter may be accomplished by various methods, such as a Fast Fourier Transform (FFT), critical filter bank, octave filter band, or one-third octave filter bank. Alternatively, the subband analysis may include a time-based filter bank. The time-based filter bank may be composed of a bank of overlapping bandpass filters, where the center frequencies have non-linear spacing such as octave, $3^{rd}$ octave, bark, mel, or other spacing techniques. FIG. 3 is flow diagram representing a method for noise estimation with music detection. The method 300 may be, for example, implemented using either of the systems 100 and 200 described herein with reference to FIGS. 1 and 2. The method 300 may include the following acts. Generating a music classification for music content in an audio signal 302. The music detector may classify the audio signal as music or non-music. The non-music signal may be considered to be signal and noise. Adjusting an adaption rate responsive to the generated music classification 304. Calculating a noise estimate applying the adjusted adaption rate 306.

The system and method for noise estimation with music detection described herein provides for generating a music classification for music content in an audio signal. The music detector may classify the audio signal as music or non-music. The non-music signal may be considered to be signal and noise. An adaption rate may be adjusted responsive to the generated music classification. A noise estimate is calculated applying the adjusted adaption rate.

All of the disclosure, regardless of the particular implementation described, is exemplary in nature, rather than limiting. The systems 100 and 200 may include more, fewer, or different components than illustrated in FIGS. 1 and 2. Furthermore, each one of the components of systems 100 and 200 may include more, fewer, or different elements than is illustrated in FIGS. 1 and 2. Flags, data, databases, tables, entities, and other data structures may be separately stored and managed, may be incorporated into a single memory or database, may be distributed, or may be logically and physically organized in many different ways. The components may operate independently or be part of a same program or hardware. The components may be resident on separate hardware, such as separate removable circuit boards, or share common hardware, such as a same memory and processor for implementing instructions from the memory. Programs may be parts of a single program, separate programs, or distributed across several memories and processors.

The functions, acts or tasks illustrated in the figures or described may be executed in response to one or more sets of logic or instructions stored in or on computer readable media. The functions, acts or tasks are independent of the particular type of instructions set, storage media, processor or processing strategy and may be performed by software, hardware, integrated circuits, firmware, micro code and the like, operating alone or in combination. Likewise, processing strategies may include multiprocessing, multitasking, parallel processing, distributed processing, and/or any other type of processing. In one embodiment, the instructions are stored on a removable media device for reading by local or remote systems. In other embodiments, the logic or instructions are stored in a remote location for transfer through a computer network or over telephone lines. In yet other embodiments, the logic or instructions may be stored within a given computer such as, for example, a CPU.

While various embodiments of the system and method for maintaining the spatial stability of a sound field have been described, it will be apparent to those of ordinary skill in the art that many more embodiments and implementations are possible within the scope of the present invention. Accordingly, the invention is not to be restricted except in light of the attached claims and their equivalents.

The invention claimed is:

1. A method, executable on one or more processors, for noise estimation with music detection, the method comprising:

generating a music classification for music content in an audio signal comprising a value selected from a range of values indicating a proportion of an amount of music content to an amount of non-music content in the audio signal and a voice classification for voice content in an audio signal;

adjusting an adaption rate responsive to the generated music classification and the generated voice classification; and calculating a noise estimate applying the adjusted adaption rate;

where the adaption rate varies inversely with the strength of the music content detected in the audio signal.

2. The method of claim 1, wherein generating the music classification comprises applying one or more of the following music detectors to the audio signal: an autocorrelation based periodicity detector, a beat detector and a high frequency harmonic detector.

3. The method of claim 2, wherein the autocorrelation based periodicity detector further comprises a downsampler and a low frequency filter.

4. The method of claim 3, wherein the downsampler discards a repeating pattern of audio samples.

5. The method of claim 1, the method further comprising:

adjusting the adaption rate responsive to the generated voice classification comprising an estimated proportion of voice content.

6. The method of claim 1, wherein adjusting the adaption rate comprises a proportional adjustment to the adaption rate responsive to changes of the generated music classification.

7. The method of claim 1, where the generated music classification further comprises smoothing over time and frequency.

8. The method of claim 1, wherein calculating the noise estimate comprises updating the calculation according to a continuous, a periodic or an aperiodic schedule.

9. A system for noise estimation with music detection comprising:

a music detector to generate a music classification for music content in an audio signal, the generated music classification comprising a value selected from a range of values indicating a proportion of an amount of music content to an amount of non-music content in the audio signal;

a voice detector to generate a voice classification for voice content in the audio signal;

a rate adaptor to adjust an adaption rate that once actuated is based on and responsive to the generated music classification and the voice classification; and a noise estimator to calculate a noise estimate applying the adjusted adaption rate;

where the adaption rate varies proportionally with the music content detected in the audio signal.

10. The system for noise estimation with music detection of claim 9, wherein the music detector further comprises one or more of: an autocorrelation based periodicity detector, a beat detector and a high frequency harmonic detector.

11. The system for noise estimation with music detection of claim 10, wherein the autocorrelation based periodicity detector further comprises a downsampler and a low frequency filter.

12. The system for noise estimation with music detection of claim 11, wherein the downsampler discards a repeating pattern of audio samples.

13. The system for noise estimation with music detection of claim 9, the method further comprising:

wherein the voice detector generates a noise classification for noise content in the audio signal.

14. The system for noise estimation with music detection of claim 9, wherein adjusting the adaption rate comprises a proportional adjustment to the adaption rate responsive to changes of the generated music classification.

15. The system for noise estimation with music detection of claim 9, wherein the music detector further smoothes the generated music classification over time and frequency.

16. The system for noise estimation with music detection of claim 9, wherein the noise estimator further updates the calculated noise estimate according to a continuous, a periodic or an aperiodic schedule.

17. The method of claim 1, where the generated music classification comprises multiple music classification values.

18. The method of claim 1, where the generated music classification comprises a music classification value for steady-state music components of the music content and a music classification value for transient music components of the music content.

* * * * *